US006325141B2

(12) United States Patent
Yamauchi et al.

(10) Patent No.: US 6,325,141 B2
(45) Date of Patent: Dec. 4, 2001

(54) TUBE

(75) Inventors: Takumi Yamauchi, Nukata-gun; Hiroshi Kokubunji, Kariya; Tatsuo Ozaki, Okazaki, all of (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 09/792,929

(22) Filed: Feb. 26, 2001

(30) Foreign Application Priority Data

Mar. 16, 2000 (JP) ..... 12-079360
Oct. 27, 2000 (JP) ..... 12-328977

(51) Int. Cl.[7] ..... F28F 1/06
(52) U.S. Cl. ..... 165/177; 29/890.053; 165/183
(58) Field of Search ..... 165/177, 183, 165/178, 179; 29/890.053, 890.054

(56) References Cited

U.S. PATENT DOCUMENTS 4,945,635 * 8/1990 Nobusue et al. ..... 29/890.053
5,579,837 * 12/1996 Yu et al. ..... 165/183
5,765,634 * 6/1998 Martins ..... 165/177
5,875,668 * 3/1999 Kobayashi et al. ..... 29/890.053
5,890,288 * 4/1999 Rhodes et al. ..... 29/890.053
6,129,147 * 10/2000 Dumetz et al. ..... 165/177
6,209,202 * 4/2001 Rhodes et al. ..... 29/890.053
6,230,533 * 5/2001 Laveran et al. ..... 165/177
6,241,012 * 6/2001 Yu et al. ..... 165/177

FOREIGN PATENT DOCUMENTS 10-193013 7/1998 (JP) .
11-118375 4/1999 (JP) .

* cited by examiner

*Primary Examiner*—Ira S. Lazarus
*Assistant Examiner*—Terrell L McKinnon
(74) *Attorney, Agent, or Firm*—Harness, Dickey & Pierce, PLC

(57) ABSTRACT

A plurality of first projections 113*a* are provided in a first side wall portion 111*a* of a grooved section 111 formed by bending part of a sheet-like workpiece to have a U-shaped cross-section, which projections extend away from a connecting portion (top) 111*c*. Since the first side wall portion 111*a* deforms to widen a groove width of the grooved section 111 due to spring-back, a tip end of the first projection 113*a* is first brought into contact with the inner wall 110*a*. Therefore, a reaction force against the compressive force is applied to the tip end of the first projection during the pre-assembly process. Since the tip end of the first projection 113*a* is not movable due to the contact with the inner wall 110*a*, a bending moment is applied to the first side wall portion 111*a* and the connecting portion 111*c* to reduce the groove width. Accordingly, as the compression progresses, the inserting section 112 is automatically rolled in the grooved section 111 to ensure secure brazing between the grooved section 111 and the inserting section 112.

6 Claims, 11 Drawing Sheets

TUBE

BACKGROUND OF THE INVENTION

1. Field of the Invention

The present invention relates to a tube, for passing a fluid therethrough, suitably used for a heat exchanger of a radiator or the like.

2. Description of the Related Art

In a heat exchanger tube disclosed in Japanese Unexamined Patent Publication No. 10-193013, a grooved receiving section of a U-shaped cross-section is formed along one side edge of a sheet-like workpiece, while an inserting section is formed along the other side edge thereof, both of which are abutted and welded together by a brazing to form a tube body for allowing a fluid to pass therethrough.

In this regard, since the grooved section of a U-shaped cross-section is formed by bending a sheet-like workpiece through a roll forming process or others, the grooved section is liable to open after the bending (roll forming) due to spring-back to increase the groove width (a distance between opposed inner walls of the groove).

This makes a gap uneven between the inner wall of the grooved section and the inserting section, resulting in a difficulty in securely fixing the grooved section to the inserting section by brazing as well as in improving the yield of the brazed tube.

SUMMARY OF THE INVENTION

An object of the present invention is to solve the above-mentioned drawbacks of the prior art by providing secure brazing of the grooved section with the inserting section.

To achieve this object, a tube is provided, according to one aspect of the present invention, constituted by inserting an inserting section (112) formed along one edge of a sheet-like workpiece into a grooved section (111) formed by bending the other edge of the sheet-like workpiece in a groove shape and by bonding both the sections together, by brazing, to define a tube body (110) for allowing a fluid to pass therethrough, characterized in that the grooved section (111) comprises a pair of opposed first and second side wall portions (111*a*, 111*b*) and a connecting portion (a top portion; 111*c*) for connecting both the first and second wall portions (111*a*, 111*b*) to define a generally U-shaped cross-section, and is disposed inside of the tube body (110) so that the second side wall portion (111*b*) is integral and contiguous with an inner wall of the tube body (110), while the first side wall portion (111*a*) is not integral and contiguous with the inner wall of the tube body (110); the first side wall portion (111*a*) having a plurality of first projections (113*a*) extending therefrom and away from the connecting portion (111*c*), and a tip end of the first projection (113*a*) abutting to an inner wall (110*a*) of the tube body (110) opposed to the connecting portion (111*c*).

As described above, because the grooved section (111) is liable to open, due to spring-back, to increase the groove width (the distance between the first and second side wall portions 111*a*, 111*b*), a tip end of the first projection (113*a*) first comes into contact with the inner wall (110*a*) when the tube body (110) is compressed in the direction parallel to the first and second side wall portions (111*a*, 111*b*).

Accordingly, a reaction force against the compressive force (applied in the parallel direction) is imparted to a tip end of the first projection (113*a*), but the tip end of the first projection (113*a*) is immobile due to the contact thereof with the inner wall (110*a*). Thereby, a bending moment is applied to the first side wall portion (111*a*) and the connecting portion (111*c*) in the direction to reduce the groove width, which causes the first side wall portion (111*a*) to approach the inserting section (112) so that the inserting section (112) is pushed toward the second side wall portion (111*b*) by the first side wall portion (111*a*) as the compression progresses.

This means that a gap (distance) between the inner wall of the grooved section (111) and the inserting section (112) is equalized in the lengthwise direction to securely nip the inserting section (112) by the grooved section (111), whereby the inserting section (112) is assuredly brazed with the grooved section (111) to improve the yield of the brazed tube.

According to another aspect of the present invention, the second side wall portion (112*a*) has a plurality of second projections (113*b*) extending therefrom, and away from the connecting portion (111*c*), and a tip end of the second projection (113*b*) abuts an inner wall of the tube body (110) opposed to the connecting portion (111*c*).

Therefore, as the first side wall portion (111*a*) approaches the inserting section (112) to cause the first side wall portion (111*a*) to push the inserting section (112) toward the second wall portion (111*b*), the second side wall portion (111*b*) is prevented from deforming away from the inserting section (112), whereby a gap between the inner wall (particularly the second side wall portion (111*b*)) of the grooved section (111) and the inserting section 112 is equalized in the lengthwise direction to securely nip the inserting section (112) by the grooved section (111).

Note that the reference numerals in brackets are used for clarifying the relationship between components of the present invention and the concrete means shown in embodiments described later.

The present invention will be more fully understood with reference to the accompanying drawings and the preferred embodiments of the invention.

DESCRIPTION OF THE PREFERRED EMBODIMENTS

Figure 1:
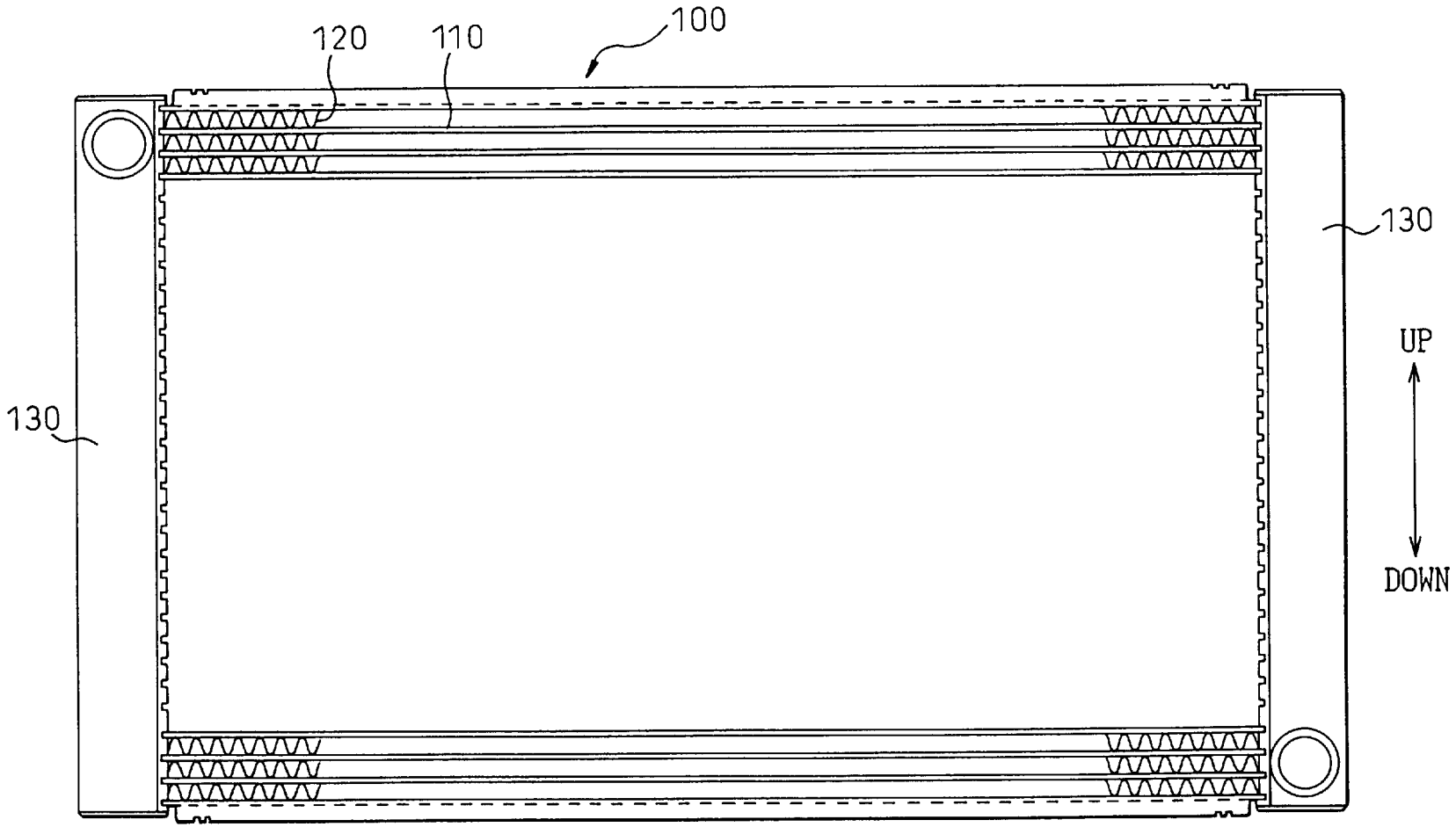
FIG. 1 is a front view of a heat exchanger (a radiator) using a tube according to one embodiment of the present invention.

This aspect relates to a car radiator (that is, a heat exchanger for exchanging heat between water for cooling a vehicle engine and air) to which a tube according to the present invention is applied. FIG. 1 is a front view of the radiator 100 of this embodiment.

In FIG. 1, 110 denotes a radiator tube (hereinafter merely referred to as a tube) of aluminum through which water (fluid) for cooling the car engine passes and 120 denotes a radiator fin (hereinafter merely referred to as a fin) of aluminum bonded to the outer surface of the tube for increasing a heat radiating area. A heat exchanging core is formed of the tubes 110 and the fins 120, for exchanging heat between engine cooling water and air. Details of the tube 110 will be described later.

Header tanks (hereinafter merely referred to as tanks) 130 of aluminum communicating with a plurality of tubes 110 are disposed at opposite ends in the longitudinal direction of the tubes 110, wherein the lefthand tank 130 as seen in FIG. 1 is used for distributing engine cooling water to the respective tubes 110, while the righthand tank 130 is for collecting the engine cooling water after the heat exchange has been completed.

The tubes 110, fins 120 and tanks 130 are bonded together with a brazing filler metal (having a melting point lower than that of aluminum forming the tube 110, fin 120 and tank 130).

Next, the description will be made of the tube 110.

Figure 2:
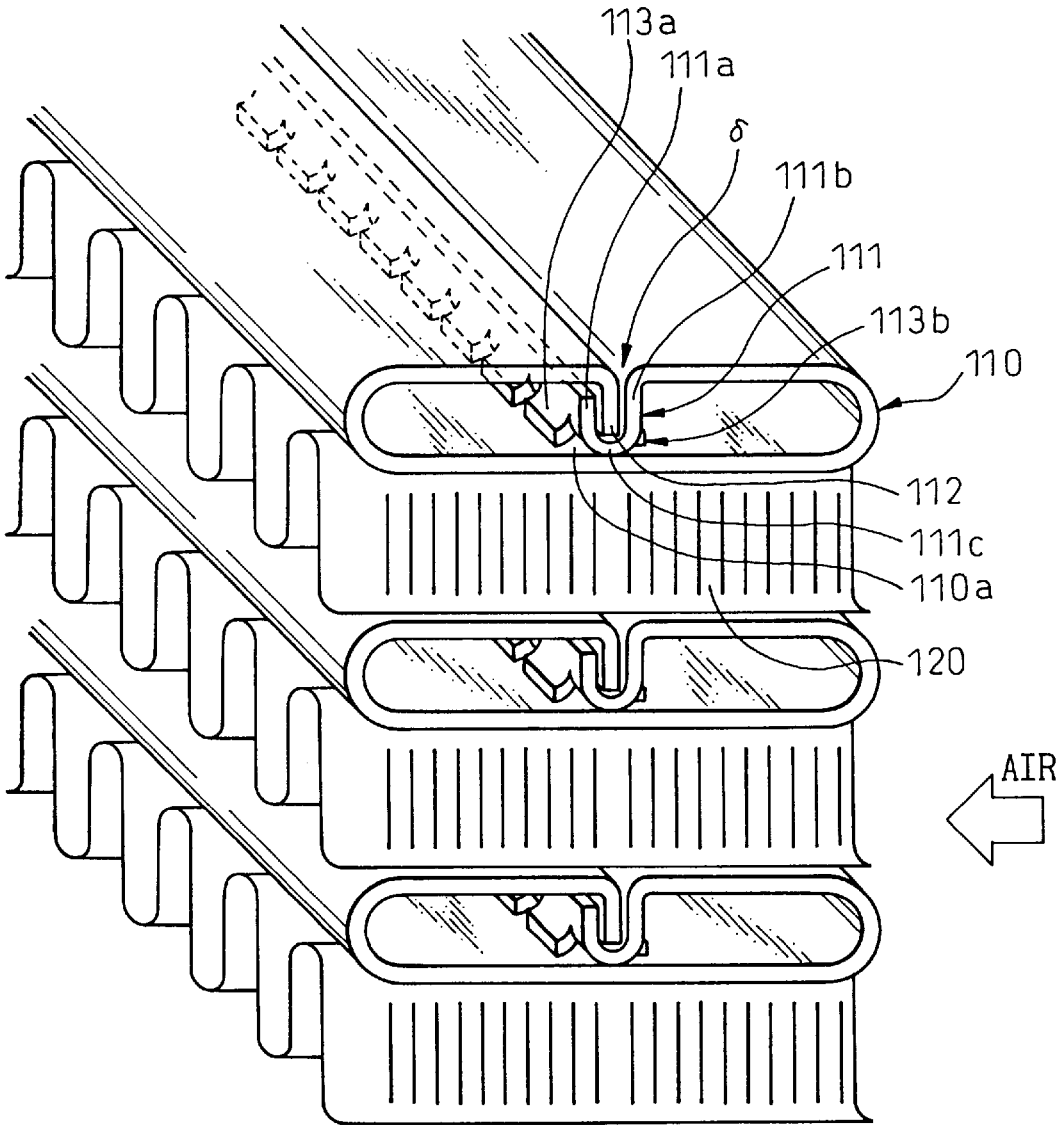
FIG. 2 is a perspective view of a heat exchanging core of the radiator shown in FIG. 1.

FIG. 2 is a sectional perspective view of a heat exchanging core wherein the tube 110 is formed to define a passage (space) for allowing engine cooling water to pass therethrough, having an oblong cross-sectional shape with a major axis in alignment with the direction of air stream and partitioned into two subpassages generally at a center of the major axis.

The tube (tube body) 110 is formed by inserting an inserting section (rolled end) 112 formed along one edge of a sheet-like workpiece into a grooved section (rolling groove) 111 formed by bending the other edge thereof, both of which sections 111, 112 are then brazed together, so that the grooved section 111 having a generally U-shaped cross-section defined by first and second side wall portions 111*a*, 111*b* opposed to each other and an arcuate connecting portion (top) 111*c* connecting the first and second side wall portions 111*a*, 111*b* to each other is positioned within the tube (tube body) 110.

In this regard, the second side wall portion 111*b* is integral and contiguous with the inner wall of the tube (tube body) 110, while the first side wall portion (rolled end) 111*a* is not integral and contiguous with the inner wall of the tube (tube body) 110 prior to being brazed since it is positioned at the edge of the sheet-like workpiece, but is integral therewith via the brazing filler metal after being brazed.

A plurality of first projections (abutment members) 113*a* are arranged in the first side wall portion 111*a* along a boundary line between the first side wall portion 111*a* and the connecting portion 111*c* and project away from the connecting portion 111*c* (lower leftward as seen in FIG. 2). Similarly, a plurality of second projections (receiving members) 113*b* are arranged in the second side wall portion 111*b* along a boundary line between the second side wall portion 111*b* and the connecting portion 111*c* and project away from the connecting portion 111*c* (lower rightward as seen in FIG. 2).

Tip ends of the first and second projections 113*a*, 113*b* are brought into contact with an area of the inner wall 110*a* of the tube (tube body) 110 opposed to the connecting portion 111*c* (the area located lower than the connecting portion 111*c* as seen in FIG. 2).

Next, the description will be made of a method for manufacturing the tube (tube body) 110 and the radiator.

Figure 3:
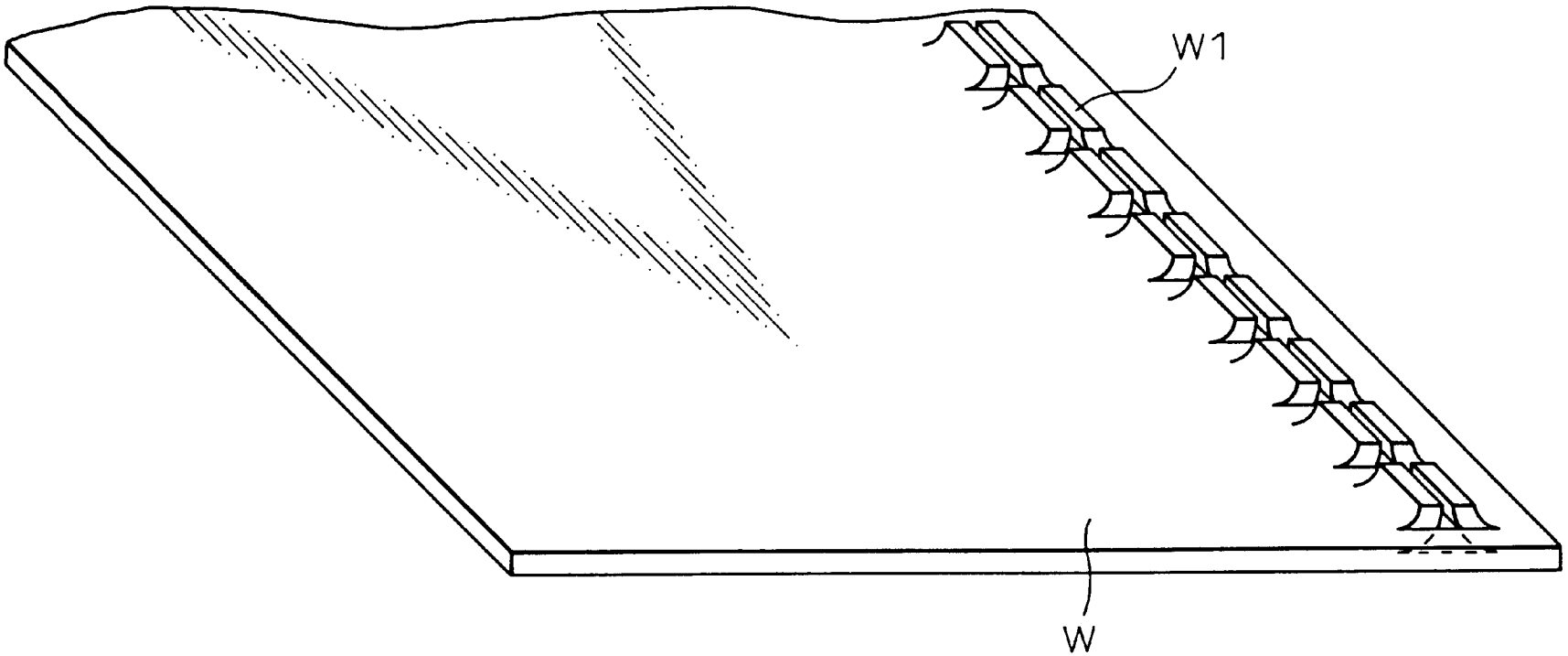
FIG. 3 is a perspective view of a workpiece used for forming the tube according to the embodiment of the present invention.
Figure 4A:
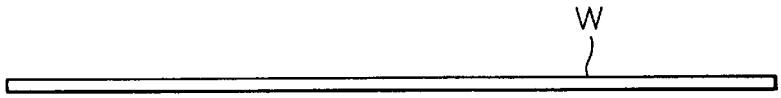
FIGS. 4A to 4E illustrate the steps for forming the tube according to the embodiment of the present invention.
Figure 4B:
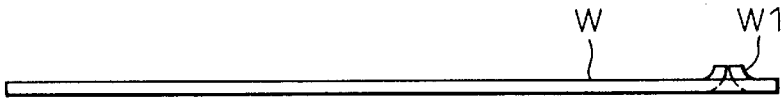
Figure 4C:
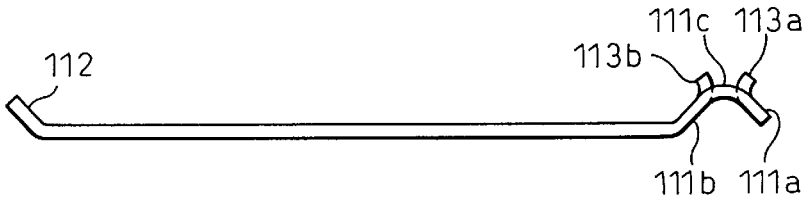
Figure 4D:
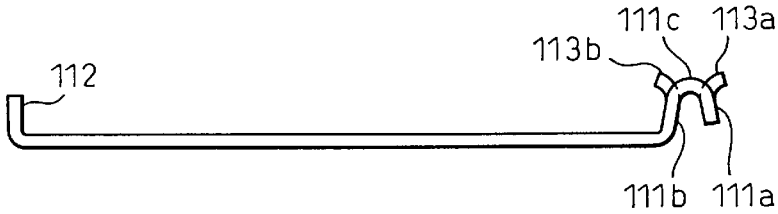
Figure 4E:
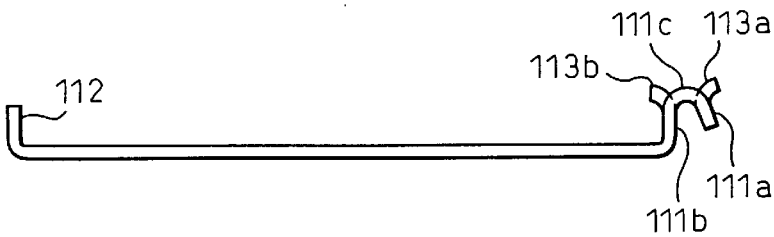

First, as shown in FIG. 3, protrusions W1 corresponding to the first and second projections 113*a*, 113*b* are formed in a sheet-like workpiece W by roll forming (a projection-forming process). One surface of the workpiece W is cladded with a brazing filler metal.

Then, as sequentially shown in FIGS. 4A, 4B, 4C, 4D and 4E, opposite edges of the workpiece W are bent to form a grooved section 111 and an inserting section 112 (an edge-forming process).

Subsequently, the workpiece W is bent as sequentially shown in FIGS. 5A, 5B, 5C and 5D to insert the inserting section 112 into the grooved section 11 to form the tube 110 (an inserting process).

Next, after the tubes 110 obtained from the inserting process are alternately superposed with fins 120 to assemble a heat exchanging core, the tubes 110 and the fins 120 are compressed together to be in close contact with each other (a pre-assembly process), after which the heat exchanging core is brazed to tanks 130 to be an integral unit (a brazing process).

Figure 5A:
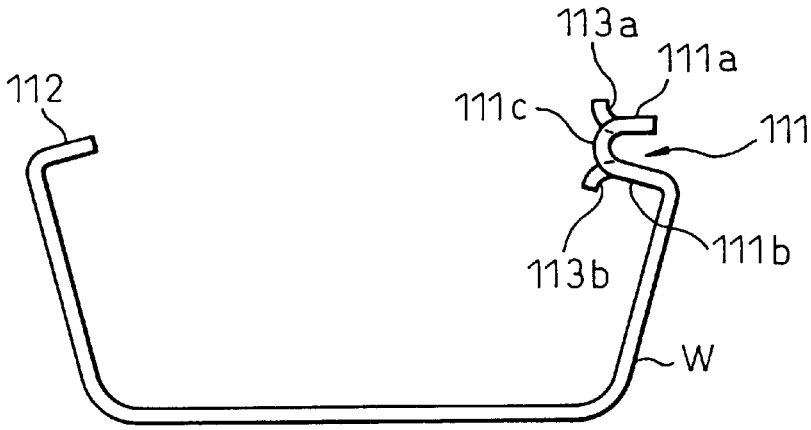
FIGS. 5A to 5D illustrate the steps for forming the tube according to the embodiment of the present invention.
Figure 5B:
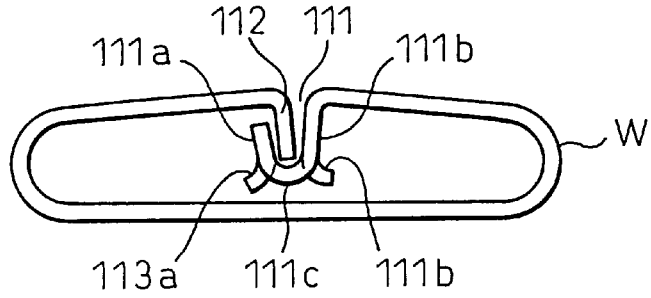
Figure 5C:
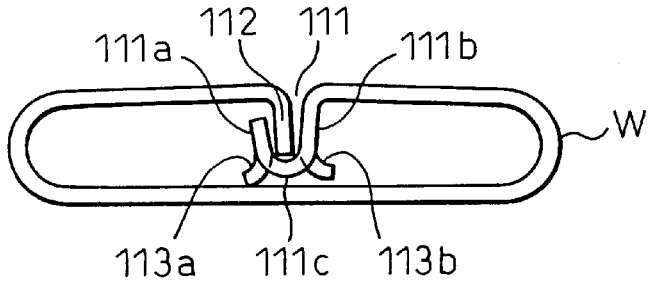
Figure 5D:
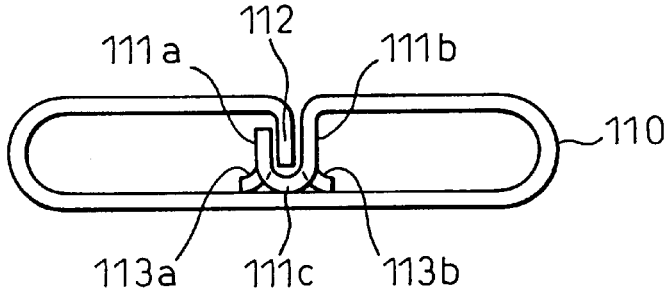
Figure 6A:
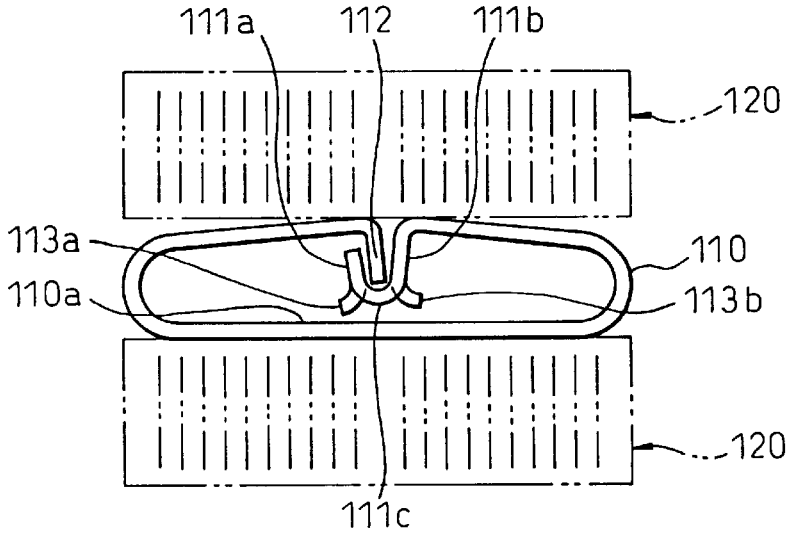
FIGS. 6A to 6C illustrate the steps for forming the heat exchanging core of the radiator shown in FIG. 1.
Figure 6B:
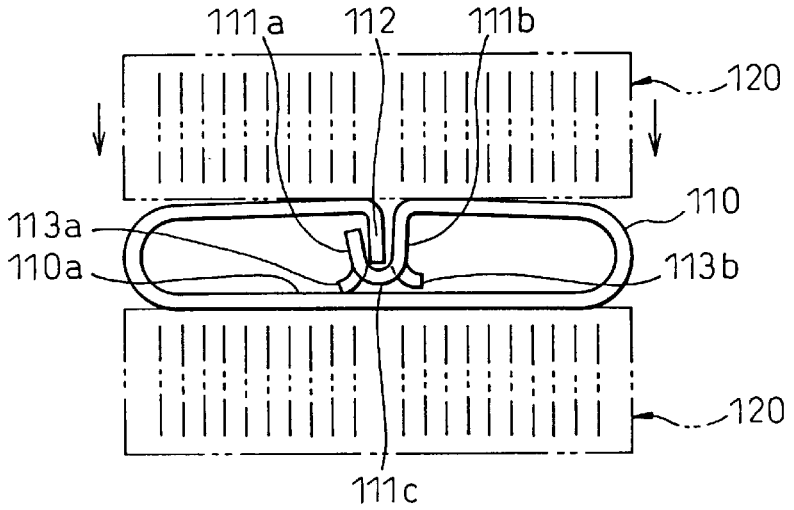
Figure 6C:
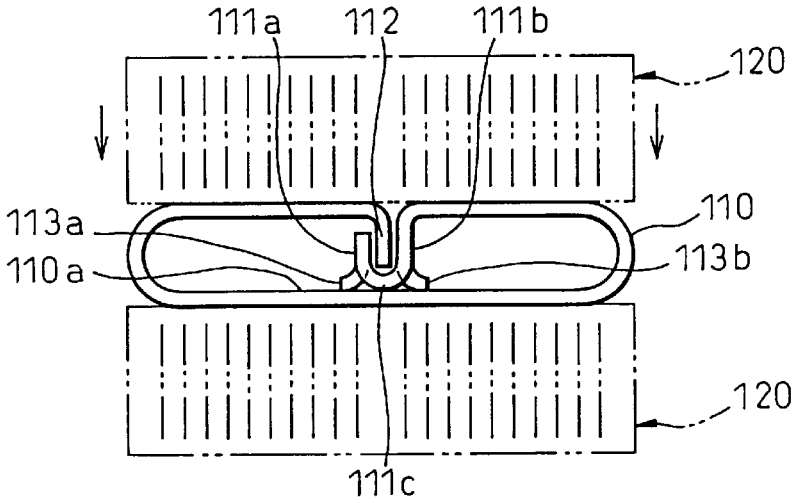

In this regard, after the completion of the inserting process, the workpiece W in a state shown in FIG. 5D is liable to return, for example, to a state shown in FIG. 5B due to spring-back. However, since the workpiece W is compressed in the direction parallel to the first and second side wall portions 111*a*, 111*b* (the direction in alignment with a minor axis of the tube 110) so that the tubes 110 and the fins 120 are in presscontact with each other during the pre-assembly process, the tubes (tube body) 110 are sequentially bent as shown in FIGS. 6A, 6B and 6C, and finally brazed while maintaining the state shown in FIG. 6C. Hereinafter, a force applied to the tubes 110 and the fins 120 for compressing them is referred to as a compressive force for pre-assembly.

The features of this embodiment will be explained below.

Since the plurality of first projections 113*a* are arranged in the first side wall portion 111*a* along a boundary line between the first side wall portion 111*a* and the connecting portion 111*c* and project away from the connecting portion 111*c*, and the groove of the grooved section 111 is widened so that a groove width (a distance between the first and second side wall portions 111*a*, 111*b*) increases due to spring-back (as seen in FIG. 6A), a tip end of the first projection 113*a* first comes into contact with the inner wall 110*a* when the tube (tube body) 110 is compressed (as seen in FIG. 6B).

Thus, since a reaction force against the compressive force for pre-assembly is applied to the tip end of the first projection 113*a* which would not move due to the tight contact thereof with the inner wall 110*a*, a bending moment operating to reduce the groove width is applied to the first side wall portion 111*a* and the connecting portion 111*c*.

Accordingly, as the compression progresses from a state shown in FIG. 6B to that shown in FIG. 6C, the first side wall portion 111*a* approaches the inserting section 112 and is brought into contact therewith to press the inserting section 112 onto the second side wall portion 111*b*.

In other words, as the compression progresses, the inserting section 112 automatically rolls in the grooved section 111 and is interposed between the first and second side wall portions 111*a*, 111*b* to make even a gap between the inner wall of the grooved section 111 and the inserting section 112 (particularly a gap δ between the second wall portion 111*b* and the inserting section 112 shown in FIG. 2) along the length of the tube. Thus, since the inserting section 112 is correctly inserted and held in the grooved section 111, it is possible to securely braze the grooved section 111 and the inserting section 112 with each other, whereby the yield of the brazed tubes can be improved and the manufacturing cost of the radiator 100 can be reduced.

Also, since the plurality of second projections 113*b* are arranged in the second side wall portion 111*b* along a boundary line between the second side wall portion 111*b* and the connecting portion 111*c* and project away from the connecting portion 111*c*, and the tip end of the second projection 113*b* is in contact with the inner wall 110*a*, it is possible to prevent the second wall portion 111*b* from deforming away from the inserting section 112 as the first side wall portion 111*a* approaches the inserting section 112 to press the latter toward the second side wall portion 111*b* (as the compression progresses from a state shown in FIG. 6B to that shown in FIG. 6C).

Accordingly, it is possible to securely hold the inserting section 112 in the grooved section 111 while equalizing a gap between the inner wall of the grooved section 111 (particularly the second wall portion 111*b*) and the inserting section 112 along the length of the tube.

While the second projections 113*b* are provided in the second side wall portion 111*b* in the above embodiment, they may be eliminated provided there are the first projections 113*a* in the first side wall portion 111*b*.

A modified embodiment of a tube 110 will be described below.

Figure 7:
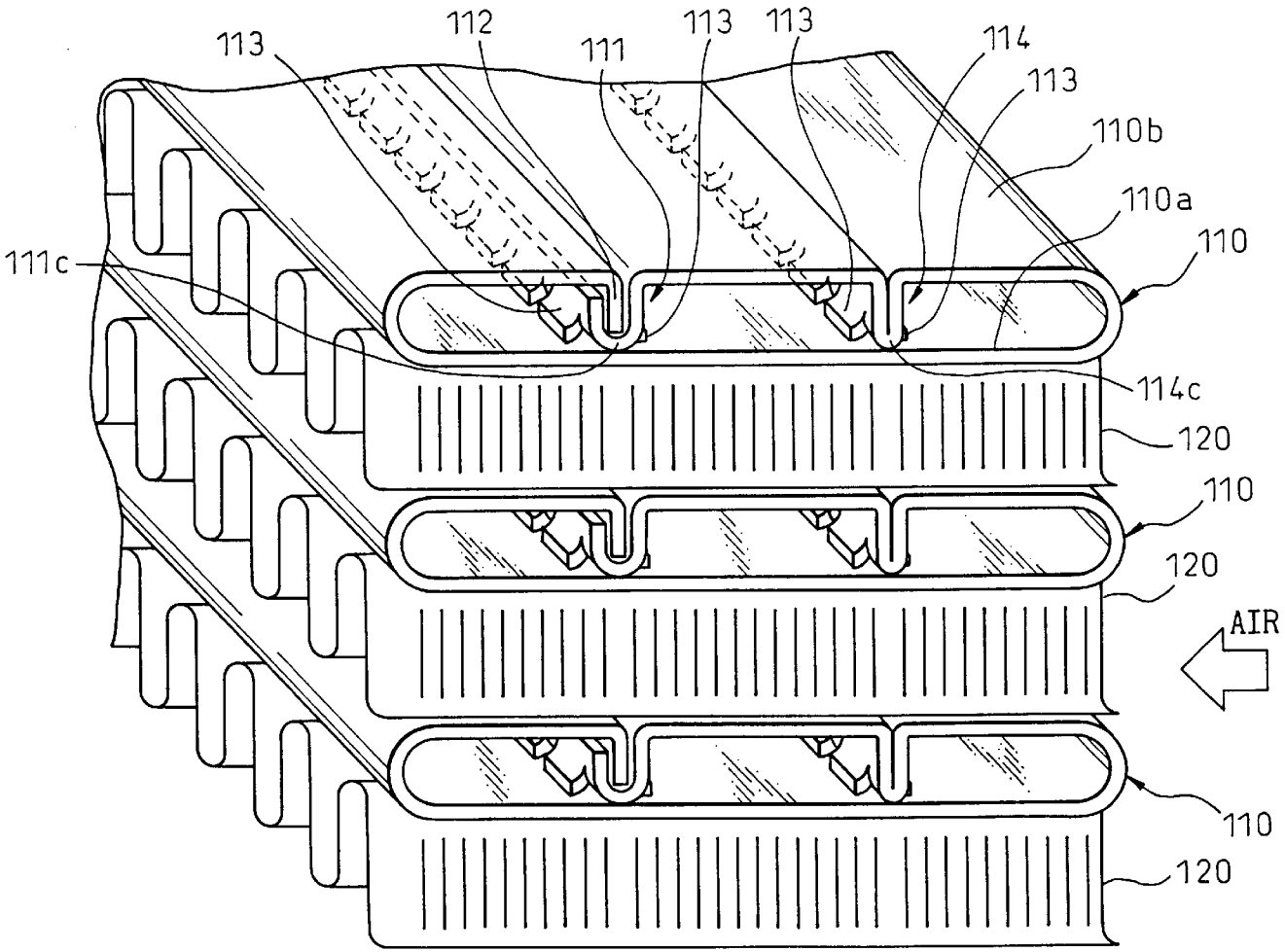
FIG. 7 is a perspective view of a heat exchanging core of the radiator according to a modified embodiment of the present invention.

FIG. 7 is a cross-sectional perspective view of a heat exchanging core using a modified embodiment of tubes 110 according to the present invention, wherein the tube (tube body) 110 is formed to define a passage (space) for allowing engine cooling water to pass therethrough, having an oblong cross-sectional shape with a major axis in alignment with the direction of air stream and partitioned into three subpassages.

111 and 114 denote a grooved section and a ridge section projecting inward of the tube 110, respectively, formed by bending a sheet-like workpiece to have a generally U-shaped cross-section. The grooved section 111 and the ridge section 114 extend in the longitudinal direction of the tube 110 and constitute wall members for partitioning the interior of the tube 110 into three subpassages.

As described later, the grooved section 111 is formed along one edge of the sheet-like workpiece, and a U-shaped groove (rolling groove) of the grooved section 111 receives an inserting section (rolled end) 112.

A plurality of projections (abutment members) 113 are formed by intermittently cutting the sheet-like workpiece W along the tops (connecting portion) 111*c*, 114*c* and opening the cut portions so that surfaces of the projections which have constituted the inner wall of the grooved section 111 and the ridge section 114 (U-shaped groove) prior to being cut are in contact with the inner wall 110*a* of the tube.

While a gap is illustrated between the inner wall of the grooved section 111 and the inserting section 112 in FIG. 7, this gap is practically filled with a brazing filler metal after the inner wall of the grooved section 111 and the inserting section 112 have been brazed together. Similarly, while the U-shaped groove of the ridge section 114 is clearly illustrated in FIG. 7, the U-shaped groove is practically collapsed so that the opposed inner walls thereof are in tight contact with each other and are filled with the brazing filler metal.

Next, a description will be given of a method for manufacturing the tube (tube body) 110 and the radiator.

Figure 8:
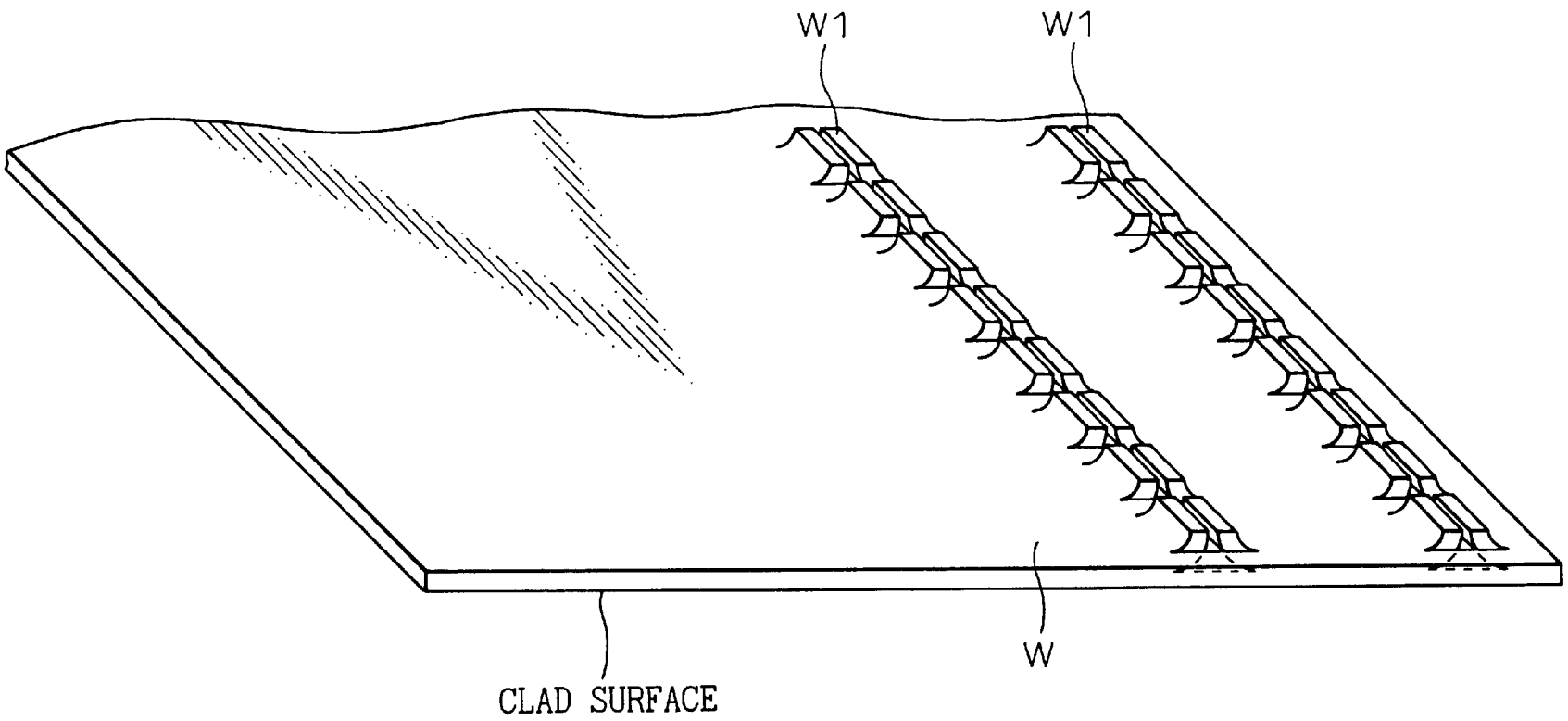
FIG. 8 is a perspective view of a workpiece used for forming the tube according to the modified embodiment.
Figures 9A, 9B, 9C, 9D, 9E:
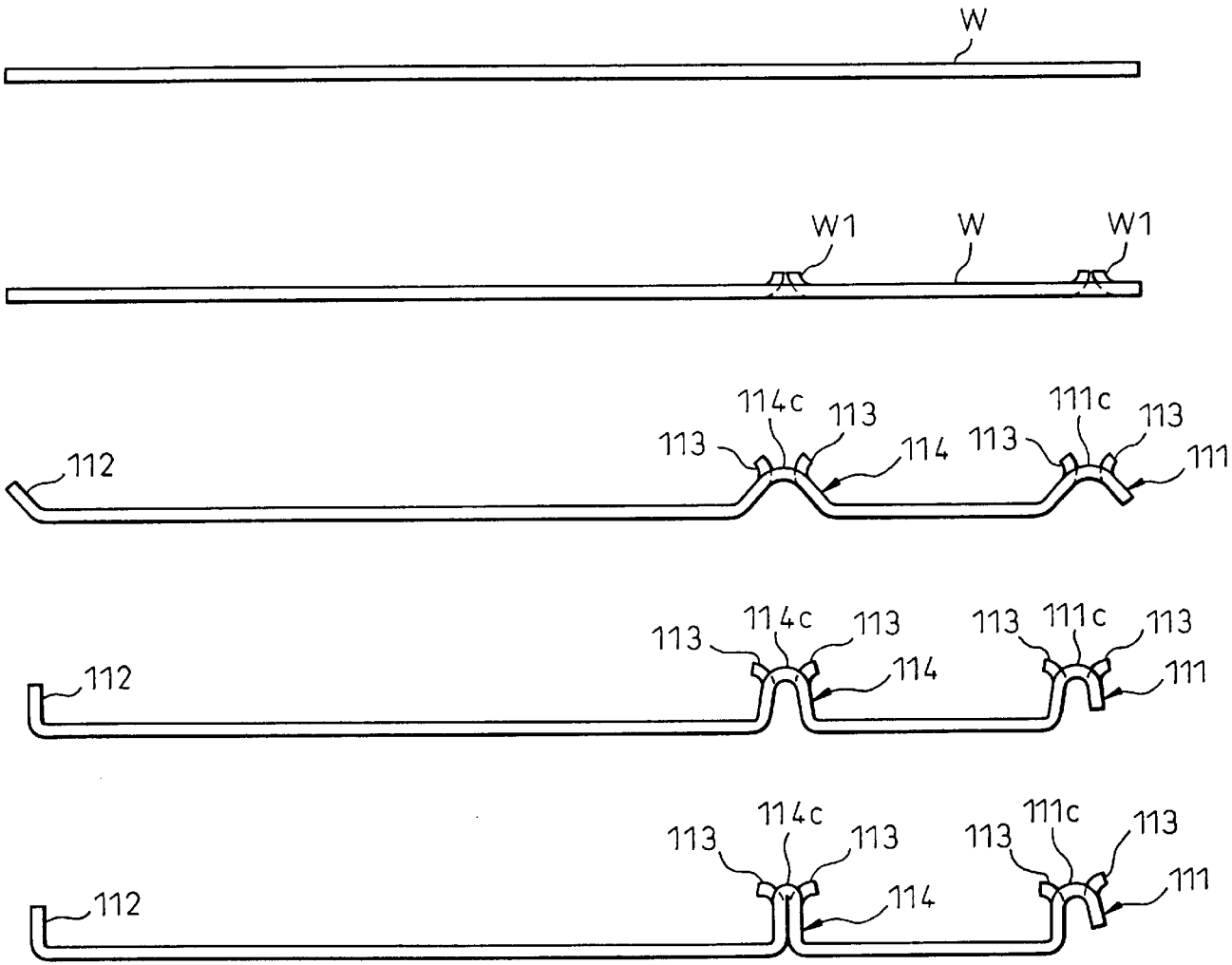
FIGS. 9A to 9E illustrate the steps for forming the tube according to the modified embodiment.

First, as shown in FIG. 8, the protrusions W1 corresponding to the projections 113 are formed in a workpiece W clad with a brazing filler metal on one surface thereof corresponding to an outer surface 110*b* of the tube 110, by intermittently cutting and opening the workpiece W so that the protrusions W1 protrude from a surface opposite to that clad with the brazing filler metal (a projection-forming process).

On the other hand, there is a sacrificial corrosive layer consisting of metal inferior to the tube 110 (aluminum) in electric potential on a surface corresponding to the inner surface (inner wall 110*a*) of the tube 110.

Then, one and the other edges of the workpiece W are bent as sequentially shown in FIGS. 9A, 9B, 9C, 9D and 9E to form the grooved section 111, the ridge section 113 and the inserting section 113 (forming process).

Thereafter, the workpiece W is bent as sequentially shown in FIGS, 10A, 10B, 10C and 10D to insert the inserting section 112 into the grooved section 111 and bring the projections 113 into contact with the inner wall 110*a* of the tube 110 (inserting/forming process).

Next, the tubes 110 obtained from the inserting/forming process are alternately superposed with the fins 120 so that a heat exchanging core is assembled, and after the tubes 110 and the fins 120 are compressed together by using a jig such as a wire (pre-assembly process), the heat exchanging core are brazed integrally with the tanks 130 (brazing process).

Figure 10A:
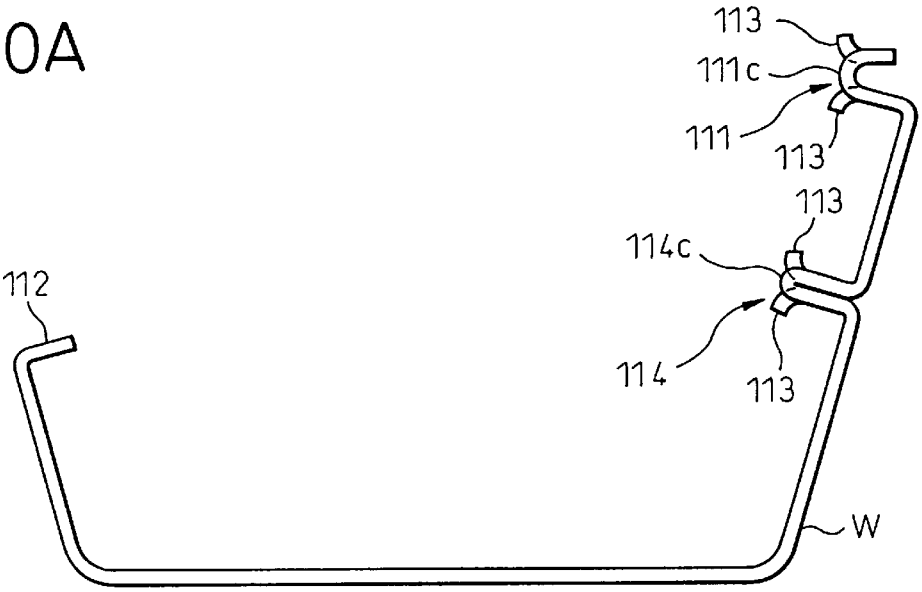
FIGS. 10A to 10D illustrate the steps for forming the tube according to the modified embodiment.
Figure 10B:
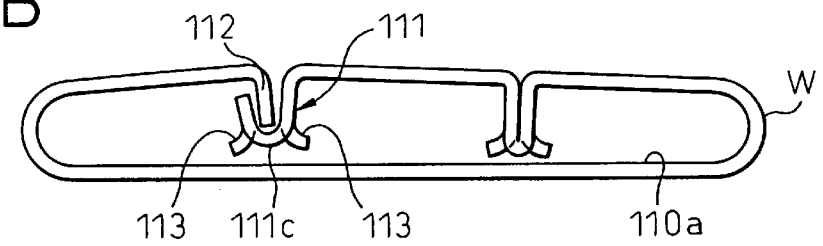
Figure 10C:
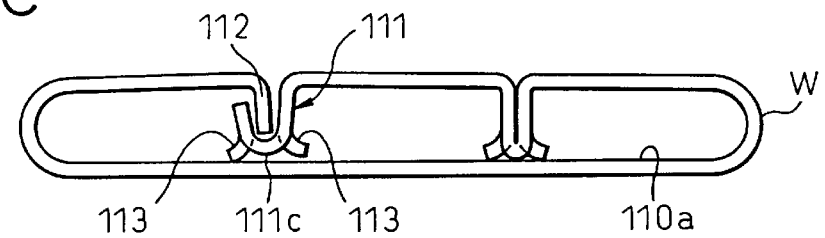
Figure 10D:
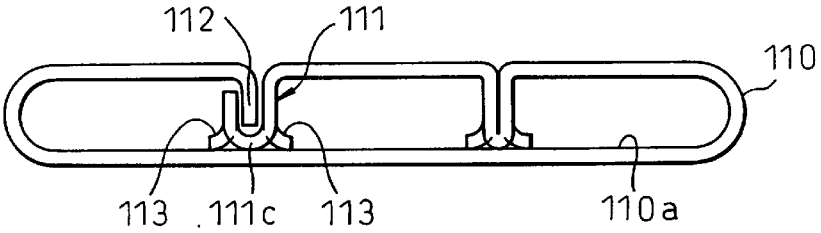

In this regard, after the completion of the inserting/forming process, the workpiece W is liable to deform from a state shown in FIG. 10D to that in FIG. 10B. However, if the tubes 110 and the fins 120 are compressed together so that they are brought into tight contact with each other during the pre-assembly process, it is possible to finally braze them as shown in FIG. 7.

The features of this modified embodiment will be described below.

According to this embodiment, since the grooved section 111 and the ridge section 114 are formed by bending part of the sheet-like workpiece W into a U-shaped cross-section, it is possible to easily produce the tube 110 having three subpassages (that is, a single tube unitizing three tubes) from a single sheet-like workpiece W.

Since the projections 113 are formed by intermittently cutting the sheet-like workpiece W along the tops 111*c*, 114*c* and opening the cut portions so that surfaces of the projections 113 which constitute the inner wall of the grooved section 111 and the ridge section 114 prior to being cut are in contact with the inner wall 110*a* of the tube, a surface portion of the projection 113 to be in contact with the inner wall 110*a* of the tube 110 is an area which has initially been clad with the brazing filler metal.

Therefore, it is unnecessary to newly coat brazing filler metal on the inner wall 110*a* or on the tops 111*c*, 114*c* for the purpose of securely brazing the tops 111*c*, 114*c* of the grooved section 111 and the ridge section 114 to the inner wall 110*a*, whereby the pressure resistance of the tube 110 can be assuredly improved without increasing the man-hours necessary for the production of the tube 110.

As described above, according to the modified embodiment, it is possible to manufacture a tube having three subpassages or more from a single sheet-like workpiece while improving the pressure resistance of the tube 110 without increasing the man-hours necessary for the production of the tube 110.

Figure 11:
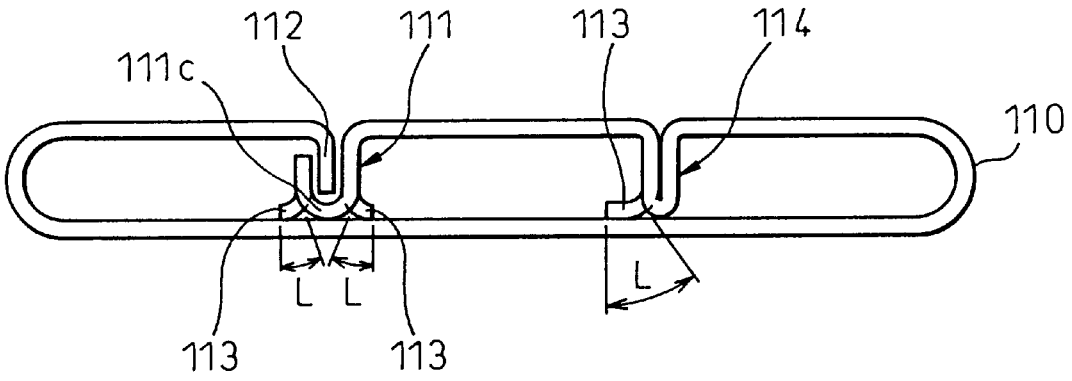
FIG. 11 is a sectional view of a tube according to a further embodiment of the present invention.

While the projections 113 are arranged on opposite sides of the grooved section 111 and the ridge section 114 to oppose to each other as shown in FIGS. 7 and 8 according to the above-mentioned modified embodiment, the projections 113 may be provided solely on one side of the ridge section 114 according to a further embodiment as shown in FIG. 11.

If the projections 113 are arranged on opposite sides of the ridge section 114 to oppose each other, a possible size of the projection 113 (a length thereof from a root to a tip) L would be approximately equal to a radius of curvature r of the top 114*c* (in practice, about 1.57 times the radius of curvature r).

Contrarily, if the projections 113 are arranged solely on one side of the ridge section 114 as in this embodiment, a possible size L of the projection 113 would be approximately twice the radius of curvature r of the top 114*c* (in practice, about 1.57×2r).

Accordingly, a contact area of the projection 113 of the ridge section 114 with the inner wall 110*a* of the tube 110 becomes larger than in a case wherein the projections 113 are arranged on opposite sides of the ridge section 114, whereby the ridge section 114 can be more firmly brazed to the inner wall 110*a* of the tube 110, which further facilitates the pressure resistance.

The above-mentioned one-side arrangement of the projections 113 is not limited to the ridge section 114 as described above, but may be applied to the grooved section 111 or both of the grooved section 111 and the ridge section 114.

While the projections 113 are provided on the left side of the ridge section 114 in the above embodiment, they may be provided on the right side instead of the left side.

While the projections 113 are arranged on both sides of the grooved section or the ridge section in a one-to-one opposed manner in the above embodiments, they may be arranged in a staggered (zigzag) manner. If the projections 113 are arranged in a staggered (zigzag) manner, it is possible to increase the size L of the projection 113 to an extent equal to in the one-side arrangement even if they are arranged on both sides of the grooved section or the ridge section.

Although the tubes 110 of the present invention are applied to the radiator 110 according to the above embodiments, the present invention should not be limited thereto but may be applicable to other uses.

While the invention has been described by reference to specific embodiments chosen for purposes of illustration, it should be apparent that numerous modifications could be made thereto by those skilled in the art without departing from the basic concept and scope of the invention.

What is claimed is:

1. A tube constituted by inserting an inserting section formed along one edge of a sheet-like workpiece into a grooved section formed by bending the other edge of the sheet-like workpiece in a groove shape and by bonding both the sections together by a brazing to define a tube body for allowing a fluid to pass therethrough, wherein the grooved section comprises a pair of opposed first and second side wall portions and a connecting portion for connecting both the first and second side wall portions to define a generally U-shaped cross-section, and is disposed inside of the tube body;

the second side wall portion being integral and contiguous with an inner wall of the tube body, while the first side wall portion is not integral and contiguous with the inner wall of the tube body;

the first side wall portion having a plurality of first projections extending therefrom away from the connecting portion, and;

a tip end of the first projection abutting an inner wall of the tube body opposed to the connecting portion.

2. A tube according to claim 1, wherein the second side wall portion has a plurality of second projections extending therefrom away from the connecting portion, and a tip end of the second projection abuts an inner wall of the tube body opposed to the connecting portion.

3. A tube according to claim 1, wherein one surface of the sheet-like workpiece to constitute the outer surface of the tube body is clad with a brazing filler metal, and the first projections are formed by intermittently cutting and raising the first side wall portion, wherein the first projections and the inner wall of the tube are brazed together with the brazing filler metal.

4. A tube according to claim 3, wherein a sacrificial corrosive layer of metal inferior to the tube body in electric potential is provided on the inner wall of the tube body.

5. A tube according to claim 2, wherein one surface of the sheet-like workpiece to constitute the outer surface of the tube body is clad with a brazing filler metal, and the second projections are formed by intermittently cutting and raising the second side wall portion, wherein the second projections and the inner wall of the tube are brazed together with the brazing filler metal.

6. A tube according to claim 1, wherein one surface of the sheet-like workpiece to constitute the outer surface of the tube body is clad with a brazing filler metal, further comprising a ridge section extending in the longitudinal direction of the tube body at a position between the grooved section and the inserting section, which is formed by bending the sheet-like workpiece to have a generally U-shaped cross-section, and a plurality of third projections formed by intermittently cutting and raising a top of the ridge section, so that a surface of the third projection initially located inside of the ridge section is brought into contact with the inner wall of the tube body and brazed with the brazing filler metal.

* * * * *